United States Patent [19]

Dietrich et al.

[11] Patent Number: 5,054,761

[45] Date of Patent: Oct. 8, 1991

[54] APPARATUS FOR TRANSFERRING FLAT ARTICLES

[75] Inventors: Walter Dietrich; Eberhard Krieger, both of Weinstadt; Siegfried Weber, Rudersberg, all of Fed. Rep. of Germany

[73] Assignee: Robert Bosch GmbH, Stuttgart, Fed. Rep. of Germany

[21] Appl. No.: 568,815

[22] Filed: Aug. 17, 1990

[30] Foreign Application Priority Data

Dec. 19, 1989 [DE] Fed. Rep. of Germany ..... 3941866

[51] Int. Cl.[5] ..... B65H 3/12

[52] U.S. Cl. ..... 271/95; 271/12; 271/99; 494/315; 414/797.8

[58] Field of Search ..... 271/91, 94, 95, 96, 271/99, 108, 11, 12; 493/315; 414/797.8

[56] References Cited

U.S. PATENT DOCUMENTS

| | | | |
|---|---|---|---|
| 3,385,595 | 5/1968 | Benatar et al. | 271/35 |
| 3,937,131 | 2/1976 | Kellogg | 493/315 X |
| 3,937,458 | 2/1976 | Langen | 271/95 |
| 4,537,587 | 8/1985 | Langen | 493/315 |
| 4,871,348 | 10/1989 | Konaka | 493/315 |

FOREIGN PATENT DOCUMENTS

| | | | |
|---|---|---|---|
| 0134628 | 3/1985 | European Pat. Off. . | |
| 729892 | 5/1955 | United Kingdom | 271/95 |
| 756890 | 9/1956 | United Kingdom | 493/315 |

*Primary Examiner*—H. Grant Skaggs
*Assistant Examiner*—Carol Lynn Druzbick
*Attorney, Agent, or Firm*—Edwin E. Greigg; Ronald E. Greigg

[57] ABSTRACT

An apparatus for taking flat erectable blanks out of a magazine and transferring them to a conveyor apparatus has a rotor, on the circumference of which suction cups are distributed, offset uniformly. The rotor is rotatably supported as a planet part in a rotating planet carrier and upon revolving is additionally rotated about its shaft by a planetary gear. In this process the suction cups travel over a self-contained cycloid path (C) having four reversal points (F, G, H, I) and intervening concave arcs. For acting upon the articles, for instance pressing on a foldable box or rotating it about a transverse axis, a cam disk is rotatable supported on the shaft of the rotor and is hindered from rotating with the rotor by being coupled to a rocker arm supported in stationary fashion. A lever guided by a roller in the cam race acts upon a pivotable pressing prong or upon the rotatably supported suction cup.

6 Claims, 4 Drawing Sheets

APPARATUS FOR TRANSFERRING FLAT ARTICLES

BACKGROUND OF THE INVENTION

The invention is based on an apparatus for transferring flat articles, in particular foldable boxes, from a delivery station to a receiving station.

In an apparatus of this type known for instance from European Patent Document A 1 34 628, a stationary suction device is disposed at a reversing point of the cycloid path of the holders or suction cups between the delivery and receiving stations; when a holder, with a foldable box lying flat, arrives at the reversal point, the wall of the foldable box opposite the wall held by the suction cup is temporarily grasped, so that when the suction cup leaves the reversal point the foldable box held by the suction cup and the suction device is erected. Since a very brief time is available for erecting it, and the path of motion of the foldable boxes is not adapted to the required erecting motion, the foldable boxes cannot be opened fully into the rectangular shape. Furthermore, foldable boxes made of a relatively rigid packaging material, because of the strains in the packaging material, virtually resume their flat shape again once the suction device is disengaged therefrom.

OBJECT AND SUMMARY OF THE INVENTION

The apparatus according to the invention has the advantage over the prior art that the position of the articles firmly held by the holders, such as suction cups, during transfer can be varied by the action of an element in motion; foldable boxes, for example, can be erected or rotated during their transfer. This influence can be exerted over virtually the entire transfer path, making a relatively long period of time available for exerting the influence. Controlled influence of this kind cannot be exerted by a cam element installed on the frame of the apparatus, because the lever which is moved by the cam and is disposed on the planet part is subjected to complex motions, including forward and backward motions relative to the cam element, which make a desired motion impossible. In contrast, the disposition of the cam element as precisely disclosed herein assures that the cam element will exert the influence needed for proper erection of the box.

Another particularly advantageous feature resides in that the foldable boxes can not only be erected but even overprinted with the prongs pivoted during their transfer.

In a further embodiment, it is possible to change the position of the article held by a suction cup, for instance rotating it about its transverse axis, so that upon transfer to the receiving station it assumes a rotated position relative to its original position in the delivery station.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
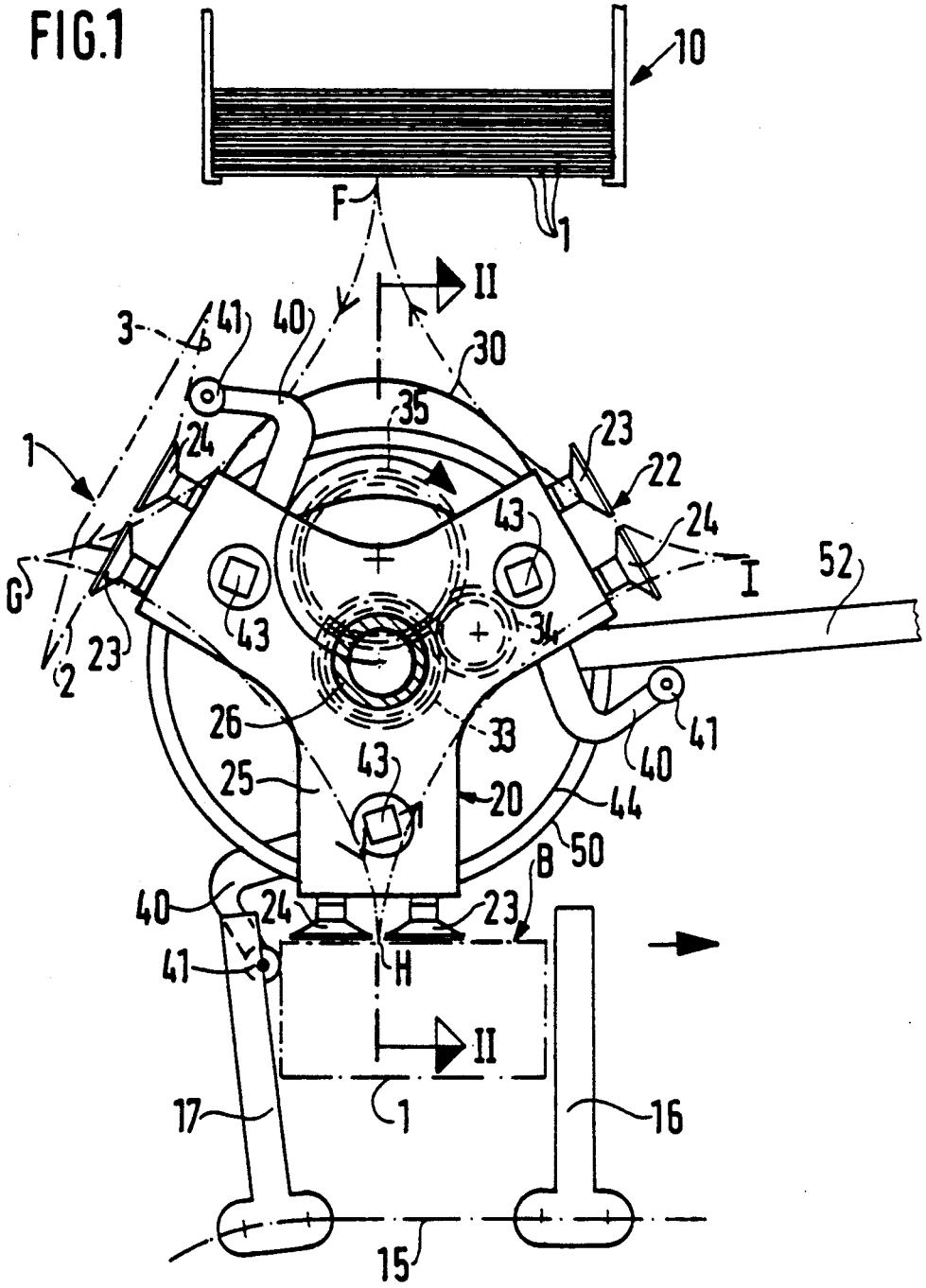
FIG. 1 is a front view of a foldable box transfer apparatus.

As shown in FIG. 1 the foldable box transfer apparatus is disposed between a magazine 10, which has a delivery station A for foldable boxes 1 lying flat, and a conveyor apparatus 15, which is equipped with carriers 16, 17 and has a receiving station B of a foldable box-making machine. For taking and grasping foldable boxes 1, the apparatus has three holders 22, such as suction cups, offset by 120° about the circumference of a rotor; each suction cup includes two pairs of suction devices 23, 24. Each pair of suction devices 23, 24 is disposed to coincide with the other pair at the ends of two three-armed holder stars 25, which are likewise secured congruently on a central shaft 26 of the rotor 20. The holder stars 25 are disposed on the shaft 26 in a manner fixed against relative rotation and such that they are adjustable in terms of spacing relative to one another.

For transferring foldable boxes 1 from the delivery station A of the magazine 10 to the receiving station B of the conveyor apparatus 15 the suction cups 22 are guided over a cycloid path C; a point approximately in the middle between the two suction devices 23, 24 of a pair follows a path having four reversal points F, G, H, I, with concave arcs between them. To produce this cycloid path C, in the exemplary embodiment shown, the rotor 20, as a planet part, is supported with an extension 31 of its shaft 26 eccentrically, and rotatably in an axially parallel manner, to the drive shaft 32 of a planet carrier 30. The extension 31 carries a planet gear wheel 33, which meshes with an intermediate wheel 34 likewise rotatably supported in the planet carrier 30. The intermediate wheel 34 is also in engagement with a sun gear wheel 35, which is firmly connected to the bearing eye 36 of the frame 37 in which the drive shaft 32 of the planet carrier 30 is supported. The gear ratio between the sun wheel 35 and the planet wheel 33 is 4:3. The radial spacing between the suction face of the various suction cups 22 and the axis of rotation of the rotor 20 is on the order of three times the eccentricity of the rotor 20 relative to the planet carrier 30.

Figure 3:
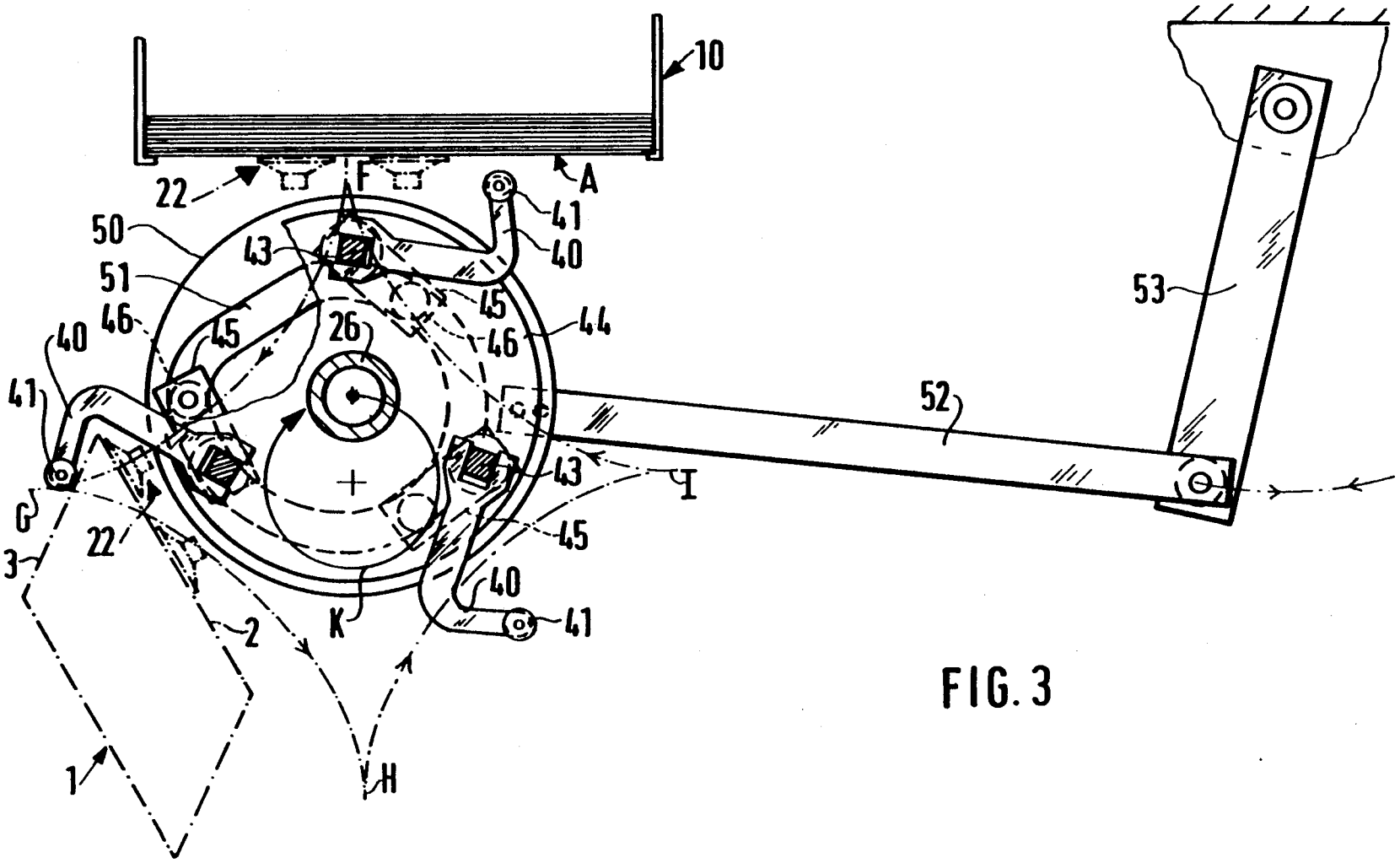
FIG. 3 shows the apparatus of FIGS. 1 and 2 in simplified form, in a different working position from that of FIG. 1.

For erecting the foldable boxes 1 taken out of the magazine 10, which are held by negative pressure by the suction cups 22 at one wall 2 of each foldable box 1, each pair of suction devices 23, 24 of the suction cups 22 has a pressing prong 40, which is bent at an angle, associated with it. During the transfer of a foldable box 1, the pressing prongs 40, likewise disposed in pairs, are pivoted against the wall 3 that borders the wall 2 to which it is connected via a fold line and that is firmly held by the suction devices 23, 24, so that a roller 41 disposed on the free, bent end of the pressing prong, resting on the wall 3, erects the foldable box 1 during rotation of the elements. The pressing prongs 40 are rotatably supported in the holder stars 25 with eyes 42 that are each penetrated in pairs by a square shaft 43 that is axially parallel with the shaft 26. Each of the square shafts 43, which are rotatably supported in a disk 44 are supported on the shaft 26 and carry a lever 45 with a roller 46 on their free end. The rollers 46 of the levers 45 are guided in a cam groove 51 of a cam disk 50. The cam disk 50 is rotatably supported, next to the disk 44, on the shaft 26 of the rotor 20. It is also firmly connected to a coupler 52, which is pivotably connected to a rocker arm 53 supported on the frame, so that the cam disk 50 upon rotation of the planet carrier 30 revolves over the circular path K of the shaft 26 of the rotor 20 but does not rotate with the rotor 20 but rather is stationary relative to it. As a result, the levers 45 are pivoted by the shaft of the cam groove 51 of the cam disk 50, such that along the segment of the path from the delivery station A to the receiving station B, the pressing prongs 40 are pivoted against the foldable box 1 held by the various suction cups 22 associated with them, and in this process, resting on one wall 4, they pivot this wall about the fold line that joins that wall 4 to the wall 2 grasped by the suction cup 22, whereupon the foldable box 1 is erected and the engaged wall is pushed even harder, to make a parallelogram (FIG. 3). This additional pressure is required to overcome the inherent tendency of the initially flat blank to return to its original condition after being assembled and its adjacent edges are glued together. After the foldable box 1 has been transferred to the receiving station B between the carriers 16, 17 of the conveyor apparatus 15, the levers 45 are pivoted back again, along the path segment between the receiving station B and the delivery station A.

To control the vacuum for the suction devices 23, 24 of the suction cups 22, so that negative pressure is generated at the reversal point F at the delivery station A and venting is performed again at the opposite reversal point H of the receiving station B, arc-shaped control grooves 55, 56 that are open toward the disk 44 are disposed in the cam disk 50 radially inside the cam groove 51. One control groove 55 communicates with a vacuum source and the other control groove 56 communicates with the ambient air. Congruently with the control grooves 55, 56, three bores are disposed offset by 120° in the disk 44; lines 57, 58 lead from these bores to the suction devices 23, 24 of the suction cups 22.

In the exemplary embodiment shown, one suction cup 22 each has two suction devices 23, 24 on one arm of the two holder stars 25. Depending on the width of a foldable box to be transferred, it may instead be practical to dispose only one suction device, or more than two of them, on one arm of a rotating star, and depending on the length of the foldable box, to dispose only one or more than two rotating stars on the shaft 26 of the rotor 20.

Figure 2:
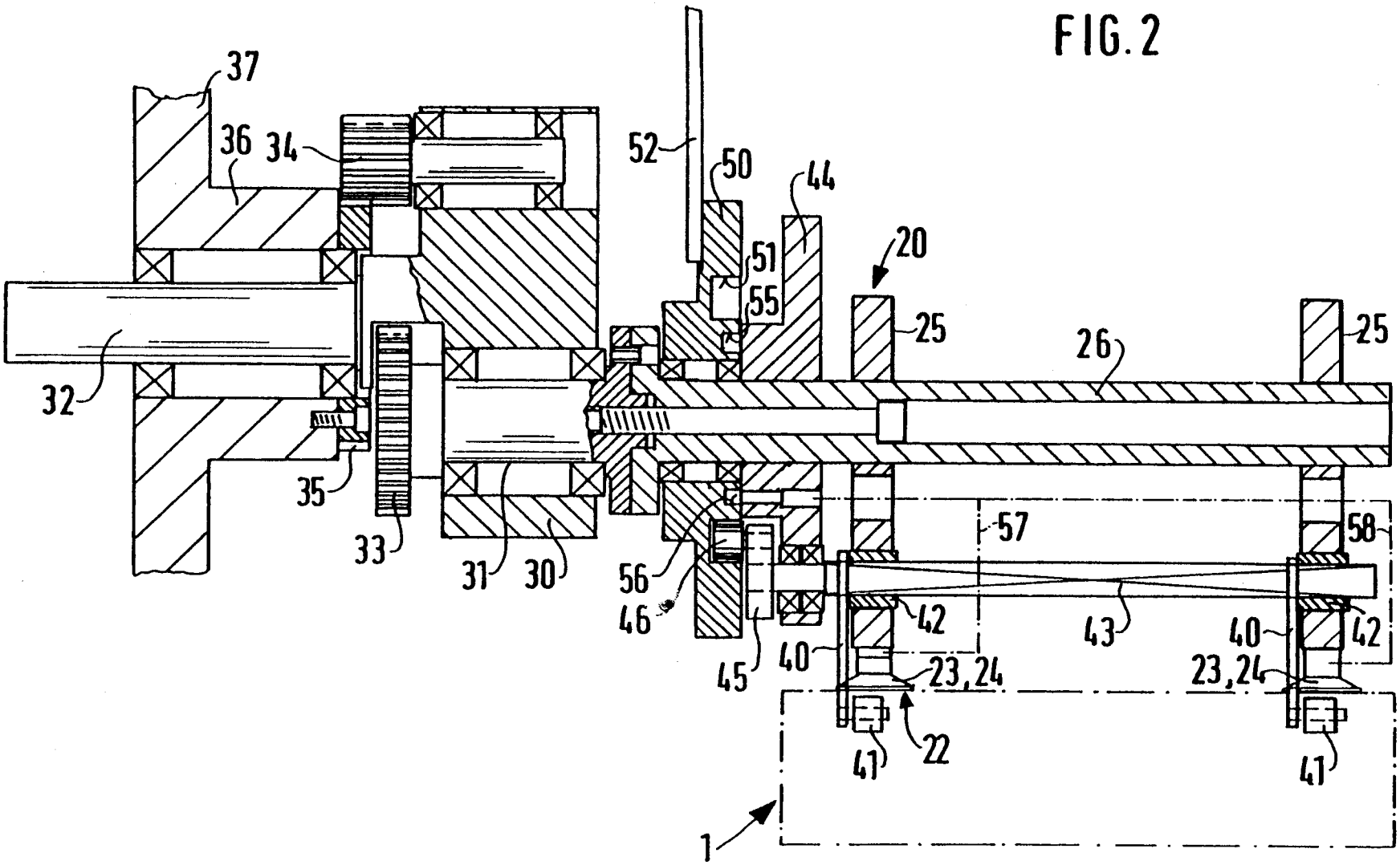
FIG. 2 shows the apparatus of FIG. 1 in a longitudinal section taken along the line II—II of FIG. 1.
Figure 4:
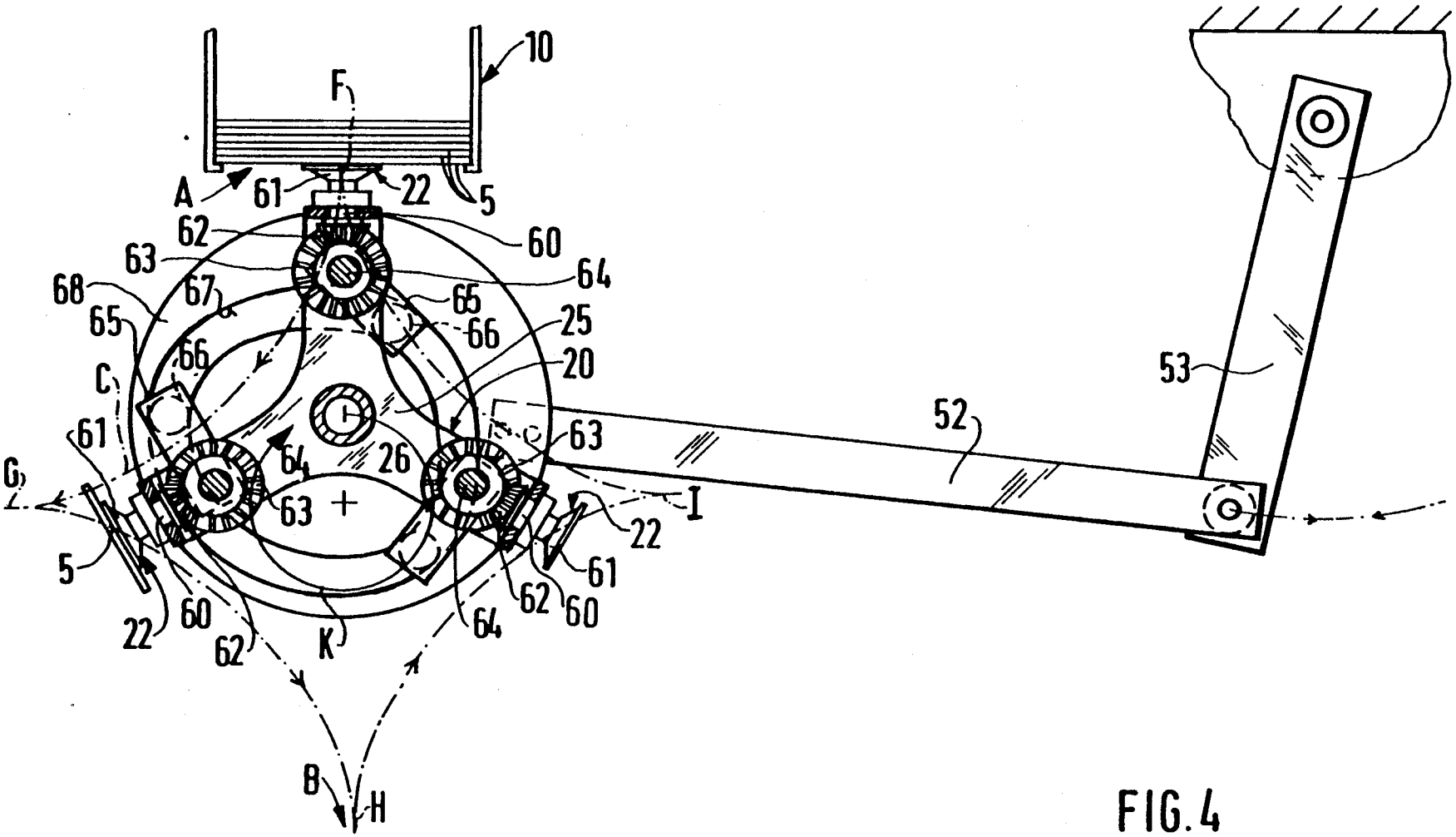
FIG. 4 shows a transfer apparatus for flat articles in simplified form, in a front view.

The exemplary embodiment of FIG. 4, in which, for the sake of simplicity, some parts of the above-described exemplary embodiment are not shown, is designed similarly to the exemplary embodiment of FIGS. 1–3; identical parts are therefore given the same names and reference numerals below. The essential difference is that flat articles, for example cards 5, are transferred from the stack 10 of delivery station A to receiving station B and are additionally rotated by 90° about their transverse axis along the transfer path. To this end, the pressing prongs as shown in FIGS. 1–3 are replaced by gears which rotate in order to rotate the cards by 90 degrees between the station A and station B. The suction cups 22 are rotatably supported about a shaft 60 that is radial to the shaft 26 of the rotor 20. The rotor 20 has only a single holder star 25 on its shaft 26, and only one suction device 61 is disposed as a suction cup 22 on each of its free ends. The radially inner end of each shaft 60 has a cone wheel 62, which meshes with a second cone wheel 63, which with a shaft 64 is rotatably supported, parallel to the shaft 26 of the rotor 20, in the holder star 25. One lever 65 having a roller 66 is firmly connected to each shaft 64 and is guided in the cam groove 67 of a cam disk 68 similar to the lever 45 and roller 46 of the modification shown in FIGS. 1–3. As in the exemplary embodiment of FIGS. 1–3 described above, this cam disk 68 is also rotatably supported on the shaft 26 of the rotor 20 and connected via a coupler 52 to a rocker arm 53 supported in stationary fashion. This arrangement assures that upon rotation of the planet carrier 30, the rotor 20 will revolve about the circular path K and be additionally rotated about its shaft 26 by the planet wheel gear, in the course of which the suction cups 22 traverse the cycloid path C, shown in dot-dash lines and having the reversal points F, G, H, I. Since the cam disk 68 is hindered from rotating about the shaft 26 by the coupler 52 and the rocker arm 53, a pivoting motion is imparted to the levers 65 upon rotation of the rotor 20 by the cam groove 51, and this pivoting motion is transmitted via the cone wheels 62, 63 to the suction device 61. As a result, a card 5 received by a suction cup 22 in delivery station A is rotated about its, transverse axis during its transfer to the receiving station B whereas in the device of FIGS. 1–3 the arms 40 functioned to actuate the box sections to form a box.

In summary, it should be noted that other movable elements like those described above, which during the transfer act in a controlled manner upon the article grasped by the suction cups, may also be provided on the transfer apparatus. A cam element installed on the frame of the apparatus is unable to exert such an influence, because the lever which is moved by the cam element and is disposed on the planet part is subjected to forward and backward motions, among others, with respect to the cam element, which a desired motion impossible.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. An apparatus for transferring flat blanks (1; 5), in particular foldable boxes, from a delivery station (A) to a receiving station (B), having at lest one suction cup holder (22) for grasping one of said flat blanks, which revolves along a self-contained cycloid path (C) having a plurality of reversal points (F, G, H, I) with curve arcs between them, an eccentrically revolving planet rotor adapted to carry the suction cup, a planet carrier (30) rotatable about a drive shaft and in which the eccentrically revolving planet rotor is supported rotatably and in an axially parallel manner by an eccentric shaft (26, 31), gear elements (33, 34, 35) associated therewith which gear elements upon rotation of the planet carrier superimpose a rotational motion upon the eccentrically revolving planet rotor, said eccentrically revolving planet rotor (20) further including at least one movable part (40; 61) for action upon the grasped flat blanks (1; 5), and the motion of said at least one movable part is controlled by a cam element (50; 68), which is rotatably supported on the eccentric shaft of said eccentrically revolving planet rotor but prevented from rotating with it.

2. An apparatus as defined by claim 1, in which at least one prong (40) associated with the suction cup (22)

is pivotably disposed on the eccentrically revolving planet rotor (20) and upon rotation of the eccentrically revolving planet rotor is pivoted via a lever (45) by a curve (51) of the cam element (50).

3. An apparatus as defined by claim 1, in which the suction cup (22) is rotatably supported on the eccentrically revolving planet rotor (20), and that a rotational motion is imparted to the suction cup by the cam element (68) via a lever (65) and gear elements (62, 63).

4. An apparatus as defined by claim 1, in which the cam element (50) is connected via a coupler (52) to a rocker arm (53) supported in stationary fashion.

5. An apparatus as defined by claim 2, in which the cam element (50) is connected via a coupler (52) to a rocker arm (53) supported in stationary fashion.

6. An apparatus as defined by claim 3, in which the cam element (68) is connected via a coupler (52) to a rocker arm (53) supported in stationary fashion.

* * * * *